United States Patent [19]

Tambascio

[11] 4,078,271

[45] Mar. 14, 1978

[54] LEG FOR BED FRAME SUPPORT

[75] Inventor: Nicholas A. Tambascio, Willoughby, Ohio

[73] Assignee: Rusco Industries, Inc., Los Angeles, Calif.

[21] Appl. No.: 732,022

[22] Filed: Oct. 13, 1976

[51] Int. Cl.[2] ..... A47C 19/00

[52] U.S. Cl. ..... 5/310; 248/188

[58] Field of Search ..... 248/188, 188.8; 5/200 R, 310

[56] References Cited

U.S. PATENT DOCUMENTS

| | | | |
|---|---|---|---|
| 2,779,952 | 2/1957 | Sten | 5/310 |
| 2,911,656 | 11/1959 | Roche et al. | 5/310 |
| 2,989,760 | 6/1961 | Sands | 5/310 |
| 3,828,376 | 8/1974 | Miller | 5/310 |

*Primary Examiner*—Casmir A. Nunberg

*Attorney, Agent, or Firm*—Oldham & Oldham

[57] ABSTRACT

The metal support leg includes vertically extending edge flanges for attachment to a dependent leg of a cross rail; the support leg has an upper end forming a substantially L-shaped corner portion to support a side rail of a bed frame, and the leg also having a substantially T-shaped intergral tab extending upwardly from its upper edge to form a stop that terminates in an overhanging horizontally extending reenforcing section.

6 Claims, 4 Drawing Figures

LEG FOR BED FRAME SUPPORT

BACKGROUND OF INVENTION

Heretofore there have been many different types of support legs provided for metal bed frames. It always has been, and still is, a problem to provide sturdy support legs for metal bed frames, but yet to make the support legs at competitive costs. The legs should be of attractive appearance and still provide effective, dependable frame and load support action. Quite a few patents have been issued on various types of support legs including U.S. Pat. Nos. 2,911,656 and 2,772,424; and 2,828,376 on a typical molded plastic support leg.

While the foregoing patents show support legs that have good properties and operating characteristics, it still is desirable to provide a sturdy metal support leg having improved operating properties, which leg can be inexpensively formed in quantity production.

The general object of the present invention is to provide a novel, improved bed frame support leg formed from a metal plate shaped to be of substantially flattened U-shape in horizontal section at its upper end and which plate has an upper edge of L-shape to provide for reenforcing supporting engagement with the lower surface of a horizontal flange of a bed frame side rail operatively engaged with the support leg in a bed frame unit.

Other objects of the invention are to provide a support leg having substantially annular form at its lower end and having a vertically extending split in such leg with the edges of the plate being inwardly turned at the split and extending the vertical length of the tubular portion of the leg for reenforcing action; to form the lower end of the leg so as to aid in engaging and supporting a caster receiving socket in the leg; to provide one or more reenforcing ribs on the leg; to provide a reenforcing and cross rail supporting tab extending upwardly and then horizontally of the support leg from its upper surface, which tab has a reenforcing notch or rib provided therein; and to provide a sturdy support leg of attractive appearance and of a design that can be produced economically in large quantities from metal plate to obtain high strength therefrom.

The foregoing and other objects and advantages of the invention will be made more apparent as the specification proceeds.

Particular attention is now directed to the accompanying drawings, wherein.

When referring to corresponding members shown in the drawings and referred to in the specification, corresponding numerals are used to facilitate comparison therebetween.

INVENTIVE SUBJECT MATTER

The metal support leg of the invention comprises a metal plate which is vertically positioned when operative and it has a substantially flattened U-shape in horizontal section at its upper end, which plate is shaped to substantially tubular form at its lower end and has a vertically extending split in such lower end and with the edges of the plate being inwardly turned and being adjacent each other at said split to reenforce the leg, the metal plate having an upper edge of L-shape for reenforcing association with the lower surface of a bed frame side rail, and the leg also having a substantially T-shaped integral tab extending upwardly from its upper edge at the center thereof and terminating in a horizontally extending, overhanging reenforcing section for engaging the side rail of a bed frame and reenforcing the same.

Figure 1:
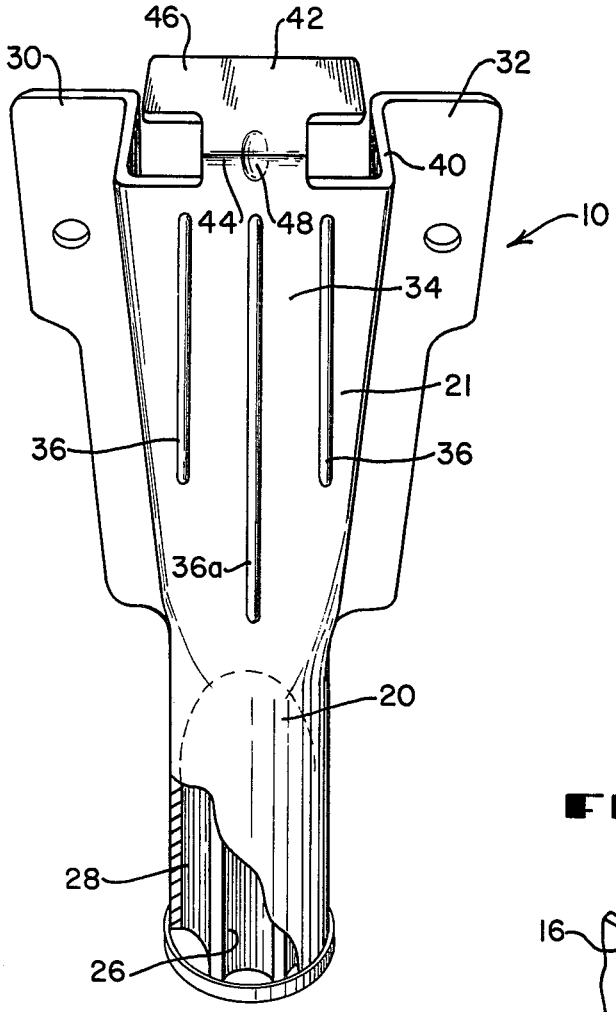
FIG. 1 is a perspective view of a metal support leg, partly broken away to show an associated caster socket, embodying the principles of the invention.
Figure 2:
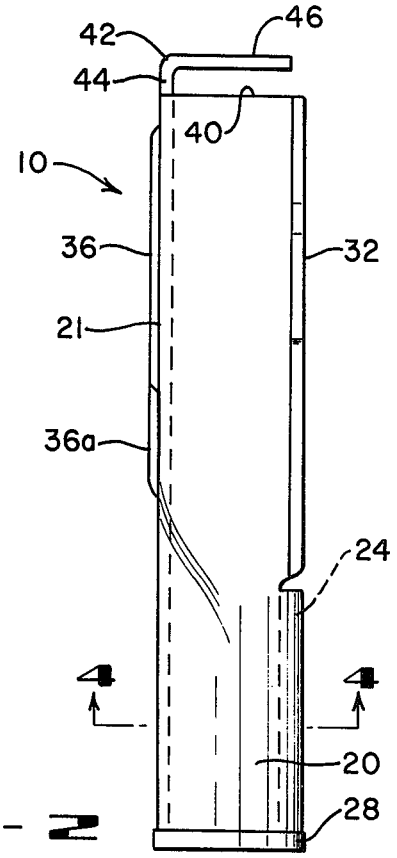
FIG. 2 is a side elevation of the support leg of FIG. 1.
Figure 4:
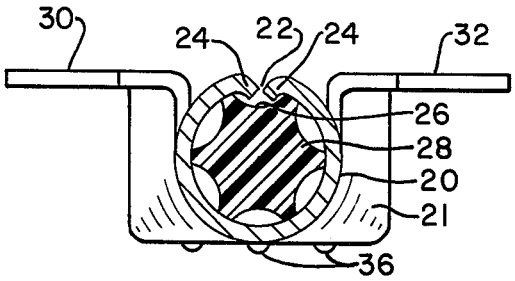
FIG. 4 is a horizontal section taken on line 4—4 of FIG. 2.
Figure 3:
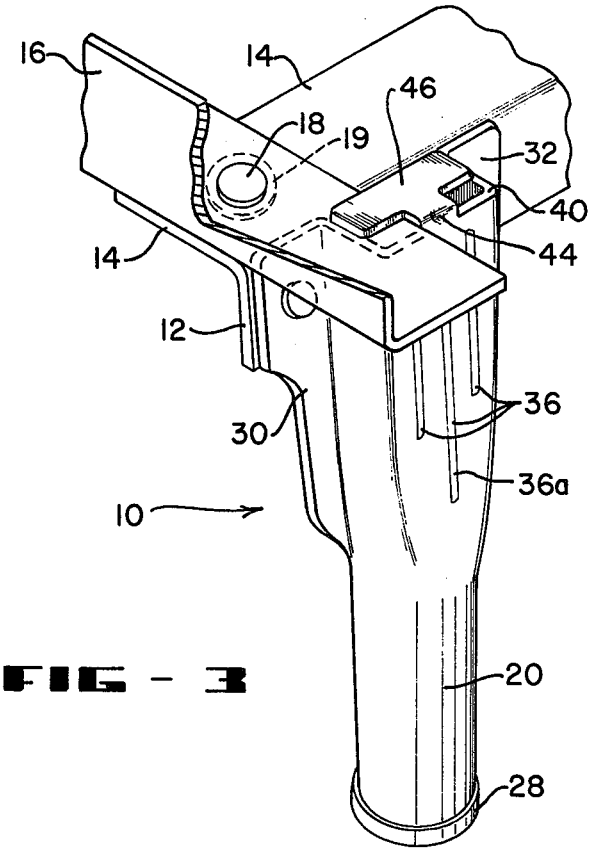
FIG. 3 is a perspective view of the support leg of the invention shown in operative engagement with a cross rail and side rail of a bed frame and having a portion of the side rail broken away for clarity.

With reference to the details of the construction shown in the drawings, a support leg is indicated as a whole by the number 10 and this leg is designed to be operatively secured to a depending flange 12 of a cross rail 14 of a bed frame. Additionally, a metal side rail 16 is provided for the bed frame and the horizontal leg or support flange of the cross rail 14 pivotally engages the side rail 16 as by a conventional rivet 18 or the like. A spacer washer 19 is positioned on the rivet between the adjacent flanges of the side and cross rails. FIG. 3 indicates the operative assembled relationship of the support leg 10, cross rail 14 and side rail 16. Of course, the cross rail 14 is adapted to be swung or pivoted inwardly with relation to the side rail 16 to be positioned thereunder and aligned therewith for storage or shipment action as is conventional in metal bed frame assemblies as made today. Such bed frames are made from two side rail units each of which has a pair of cross rail sections secured thereto and wherein normally the cross rail sections then are operatively engaged with each other to form the bed frame assembly.

The drawings show that the support leg 10 has a substantially flattened U-shape, in horizontal section, portion 21 at its upper end and the lower end of the support leg is of substantially annular shape, as indicated at 20. The lower end 20 of the leg has a vertically extending split 22 formed therein and the edges of the metal plate forming the leg have inwardly turned vertically extending reenterant edge flanges 24 that are positioned closely adjacent each other. These edge flanges 24 extend the vertical height of the tubular or annular lower end of the leg. Such edge flanges 24 are received in a surface recess 26 extending vertically of a plastic caster socket 28 that is positioned in the lower end of the leg and frictionally engaged therewith. The recess 26 extends the height of the socket 28 and is open at its upper end.

The support leg 10 has vertically extending flat edge flanges or wings 30 and 32 protruding from its upper lateral margins. It should be noted that the support leg 10 in the U-shaped upper portion 21 thereof tapers inwardly in width from an enlarged upper end thereof down to the lower part of the upper section that engages the annular lower portion of the support leg. Such upper portion of the support leg is of open box shape adjacent the cross rail whereas the lower portion 20 of the support leg is of annular shape to give it strength and to position a support member therein. A base portion 34 of the upper section 21 is usually flat and it has a plurality of vertically extending ribs 36 provided therein and protruding outwardly therefrom to reenforce and strengthen the support leg with a center rib **36*a* being longer than the adjacent laterally outer ribs. Usually the upper edge flanges 30 and 32 are riveted to the dependent flange 12 of the cross rail 14**.

An upper edge 40 of the support leg 10 normally lies in a plane and is horizontally positioned in a bed frame. Such upper edge 40 is immediately below the lower surface of the side rail 14 whereby when the cross rail is operatively positioned and extends perpendicularly in relation to the side rail, then the side rail's horizontal flange is supported against downward deflection on this straight edge 40.

Yet a further feature of the support leg 10 is that it is provided with a substantially T-shaped tab 42 that extends upwardly from the upper edge of the support leg and is connected integrally thereto as by a center section 44 that connects to a horizontally extending overhanging reenforcing section 46 formed at the upper portion of the tab 42. Such overhanging section is spaced a distance from the upper edge 40 as to engage with or be immediately adjacent the upper surface of the horizontal flange of the side rail 16 to reenforce the same and prevent upward deflection thereof. At the same time, the center section 44 of the tab provides a stop to limit pivotal movement of the side rail in relation to the cross rail 14 and provide for perpendicular operative relationship of the two rails.

This center portion 44 of the tab normally has an inwardly extending indent or rib 48 formed therein which strengthens the tab and aids in forming a strong stop and reenforcing unit from the tab means.

By the present invention, a sturdy, improved support leg 10 can be made from a metal plate of conventional composition and gage. This plate, when shaped to leg form, has good support action and a good operative life when used for bed frame support action. It provides a sturdy leg at a reasonable cost. The ribs 36, edge flanges 24, upper edge flanges 30 and 32, rib 48, etc. all add strength to the support leg. Thus, the objects of the invention have been achieved.

While one complete embodiment of the invention has been disclosed herein, it will be appreciated that modification of this particular embodiment of the invention may be resorted to without departing from the scope of the invention.

What is claimed is:

1. A metal support leg for a bed frame or the like, comprising a metal plate adapted to be positioned vertically when operative and being of substantially flattened U-shape in horizontal section at its upper end, the plate having a substantially annular form at its lower end, said plate having an exposed upper corner edge of L-shape in horizontal section for reenforcing engagement with the lower surface of a bed frame side rail when the support leg is operatively positioned in a bed frame and a load is applied to the bed frame.

2. A metal support leg as in claim 1 where the lower annular end of said leg has a vertically extending split in it and the edges of the plate are inwardly turned at said split.

3. A metal support leg as in claim 1 and where vertically extending edge flanges for attachment to a dependent leg of a cross rail are formed on the support leg and, a substantially T-shaped integral tab extending upwardly from its upper edge at the center thereof and terminating in a horizontally extending reenforcing section.

4. In combination, a bed frame side rail, a cross rail, means pivotally securing said cross rail to said side rail, and a metal support leg including vetically extending edge flanges on the leg for attachment to a dependent leg of the cross rail, said support leg having an open upper end forming, in horizontal section, an L-shaped corner portion adjacent and directly below said side rail to support the side rail of a bed frame when the side and cross rails are operably positioned, said leg having a substantially T-shaped integral tab extending upwardly from its upper edge at the center thereof and terminating in a horizontally extending reenforcing section that overlies the side rail when the frame is operative to reenforce such side rail against distortion upwardly.

5. A combination as in claim 4, wherein said tab has a connecting portion extending up from said leg upper edge to form a stop to engage the bed frame side rail on relative pivotal movement of the side rail and the cross rail, said reenforcing section being parallel to and closely adjacent the horizontal flange of the bed frame side rail when the bed frame is operatively positioned.

6. A combination as in claim 4 where said support leg is of annular shape at its lower end and a vertically extending split is formed in such lower end and extends the height thereof, the lower end of said support leg having reenterant flanges extending along the edges of said split for the length thereof.

* * * * *